US009222744B2

(12) United States Patent
Beck

(10) Patent No.: US 9,222,744 B2
(45) Date of Patent: Dec. 29, 2015

(54) APPARATUS AND METHOD FOR SAFE HANDLING OF STRIKER-FIRED FIREARMS

(71) Applicant: Robert Louis Beck, Carlsbad, CA (US)

(72) Inventor: Robert Louis Beck, Carlsbad, CA (US)

( * ) Notice: Subject to any disclaimer, the term of this patent is extended or adjusted under 35 U.S.C. 154(b) by 0 days.

(21) Appl. No.: 14/280,447

(22) Filed: May 16, 2014

(65) Prior Publication Data

US 2015/0184966 A1 Jul. 2, 2015

Related U.S. Application Data

(60) Provisional application No. 61/824,676, filed on May 17, 2013.

(51) Int. Cl.
*F41A 17/64* (2006.01)

(52) U.S. Cl.
CPC ..... *F41A 17/64* (2013.01)

(58) Field of Classification Search
CPC ..... F41A 17/56; F41A 17/64; F41A 17/74
USPC ..... 42/70.08, 70.01, 70.04, 70.05, 70.06
See application file for complete search history.

(56) References Cited

U.S. PATENT DOCUMENTS

| | | | | |
|---|---|---|---|---|
| 1,996,393 | A * | 4/1935 | White | 89/154 |
| 6,389,728 | B1 * | 5/2002 | Lundy | 42/70.11 |
| 6,405,470 | B1 * | 6/2002 | Strahan | 42/70.08 |
| 6,601,331 | B2 | 8/2003 | Salvitti | |
| 7,051,468 | B2 * | 5/2006 | Glock | 42/70.06 |
| 7,703,230 | B2 * | 4/2010 | Curry et al. | 42/70.08 |
| 7,827,720 | B1 * | 11/2010 | Erdem | 42/70.08 |
| 8,528,242 | B2 | 9/2013 | Green et al. | |
| 2001/0037596 | A1 * | 11/2001 | Salvitti | 42/70.08 |
| 2002/0194762 | A1 * | 12/2002 | Cominolli | 42/70.06 |
| 2003/0089014 | A1 * | 5/2003 | Schuerman | 42/16 |
| 2013/0000173 | A1 * | 1/2013 | Green et al. | 42/70.11 |

* cited by examiner

*Primary Examiner* — Joshua Freeman
(74) *Attorney, Agent, or Firm* — Cionca Law Group P.C.; Marin Cionca

(57) ABSTRACT

A safety apparatus for striker-fired weapons, mountable at the back end of the weapon's slide and comprising a spring loaded button associated with a ram bar, wherein, when the spring loaded button is actuated by a user, the ram bar temporarily displaces a component of the weapon's firing mechanism, such that, although the weapon's trigger can still move full range, discharge of the weapon is prevented and the weapon is thus temporarily in safe mode; and wherein, as soon as the user releases the spring loaded button, the spring loaded button returns to its position before actuation by the user, causing the ram bar to stop the temporary displacement of the component of the weapon's firing mechanism, the weapon being thus returned to its normal, ready-to-fire mode.

14 Claims, 10 Drawing Sheets

APPARATUS AND METHOD FOR SAFE HANDLING OF STRIKER-FIRED FIREARMS

CROSS-REFERENCE TO RELATED APPLICATIONS

This application claims the benefit of U.S. Provisional Application No. 61/824,676 filed May 17, 2013, which is hereby incorporated by reference, to the extent that it is not conflicting with the present application.

BACKGROUND OF THE INVENTION

1. Field of the Invention

The invention relates generally to weapons and particularly to a safety apparatus and method for safe handling and holstering of striker-fired firearms.

2. Description of the Related Art

Striker-fired firearms, such as the Glock™ or Smith and Wesson MP™ series, are well known in the art. The structural and functional design of the firing mechanism of various striker-fired weapons may vary. However, all striker-fired weapons typically include a trigger, a trigger bar that is operatively connected to the trigger, and a spring loaded striker.

The firing mechanism of a Glock™ pistol has a spring-loaded striker that is cocked in two stages that the striker spring powers. When the pistol is charged, the striker is preloaded in the half-cock position. As the trigger is pulled, the striker is then fully drawn to the rear and cocked. At the end of its travel, the trigger bar is tilted downward by the connector, releasing the striker to fire the cartridge. The connector resets the trigger bar so that the striker will be captured in half-cock at the end of the firing cycle. Cycling of the slide achieves this connector reset action.

Striker-fired firearms have been widely adopted by law enforcement, military and civilians, as a sidearm. They are preferred for their simplicity of design, maintenance, manual of arms, and excellent reliability. While existing striker-fired firearms have multiple internal safeties to prevent accidental discharge (AD) while being handled or dropped, most designs only require a deliberate pull of the trigger to fire the weapon. A majority of users prefer the simplicity of this manual of arms. The weapon is ready to fire at all times as long as a bullet is in the chamber.

There are also manual safety options currently on market, which the user may engage but they have not been widely adopted. This is likely because these manual safeties are switched in distinct on or off positions, leaving the possibility that the safety could be left on safe mode by accident, and thus, user is unaware that the weapon is not ready to use. This may be deadly in certain circumstances. Thus, users prefer the weapon always being ready to fire compared to the option of having a manual safety. It is believed that this is preferred particularly in high stress combat situations when a manual safety set on "safe" might be forgotten and the weapon would not fire when needed most.

While it seems that most users prefer an always ready-to-fire weapon, there are drawbacks associated with such a weapon. The major drawback of striker-fired firearms without manual safeties is that it is not uncommon to have an accidental discharge while handling the weapon, holstering it, or removing it from the holster. For example, upon inserting the striker fired firearm in a holster, it is not uncommon for users to forget to remove their finger from the trigger area, and by the holster pushing the finger into the trigger, causing the firing of the weapon. Worse yet, objects such as clothing, debris, or parts of a well-worn holster may get stuck in the trigger areas as the user pushes the firearm into the holster, pulling the trigger and firing the weapon without the user having any warning. This is commonly called "Glock Leg" as the user might shoot herself in the leg. An Internet search will provide ample examples of such accidents. In other cases, users have had an accidental discharge while removing their striker-fired firearm from their holster simply by riding the trigger as the weapon is removed and firing too soon. Certain holster retaining safety apparatus, seem to lend themselves to this kind of accidental discharge.

Some prior art safety apparatus acts on the striker. It is believed that any safety apparatus that acts on striker lends itself to serious safety issues of firing slightly out of battery under certain conditions. Out of battery discharges are well known to destroy these weapons and harm users. A simple Internet search of "Glock Kaboom" will show many examples. Such safety apparatus may block the movement of the striker only while user is applying compensatory force through her thumb, which has to be enough, such that to prevent movement of the trigger. One problem with such safety apparatus is that accidental discharge may still occur if the force applied to the trigger, by an object or by user's finger, outweighs the force applied to the striker.

Thus, there is a need for a new and improved safety apparatus for striker-fired weapons that solves the problems identified above.

The problems and the associated solutions presented in this section could be or could have been pursued, but they are not necessarily approaches that have been previously conceived or pursued. Therefore, unless otherwise indicated, it should not be assumed that any of the approaches presented in this section qualify as prior art merely by virtue of their presence in this section of the application.

BRIEF SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In one exemplary embodiment, the safety apparatus disclosed herein is installed at the rear of slide of the weapon and gives the operator the option of pressing the apparatus to disengage the trigger. In this exemplary embodiment, the safety apparatus acts on the weapon's factory connector and prevents the trigger bar from releasing the striker, thus making the weapon safe momentarily. The safety apparatus is spring loaded to return to a firing position as soon as the user releases the apparatus' button, thus the weapon is quickly ready to fire. Thus, an advantage of the safety apparatus disclosed herein is that it aids in the reduction of accidental discharge or negligent discharge by a user while handling or holstering the weapon.

The above embodiments and advantages, as well as other embodiments and advantages, will become apparent from the ensuing description and accompanying drawings.

BRIEF DESCRIPTION OF THE DRAWINGS

For exemplification purposes, and not for limitation purposes, embodiments of the invention are illustrated in the figures of the accompanying drawings, in which.

DETAILED DESCRIPTION OF THE PREFERRED EMBODIMENTS

Figure 1:
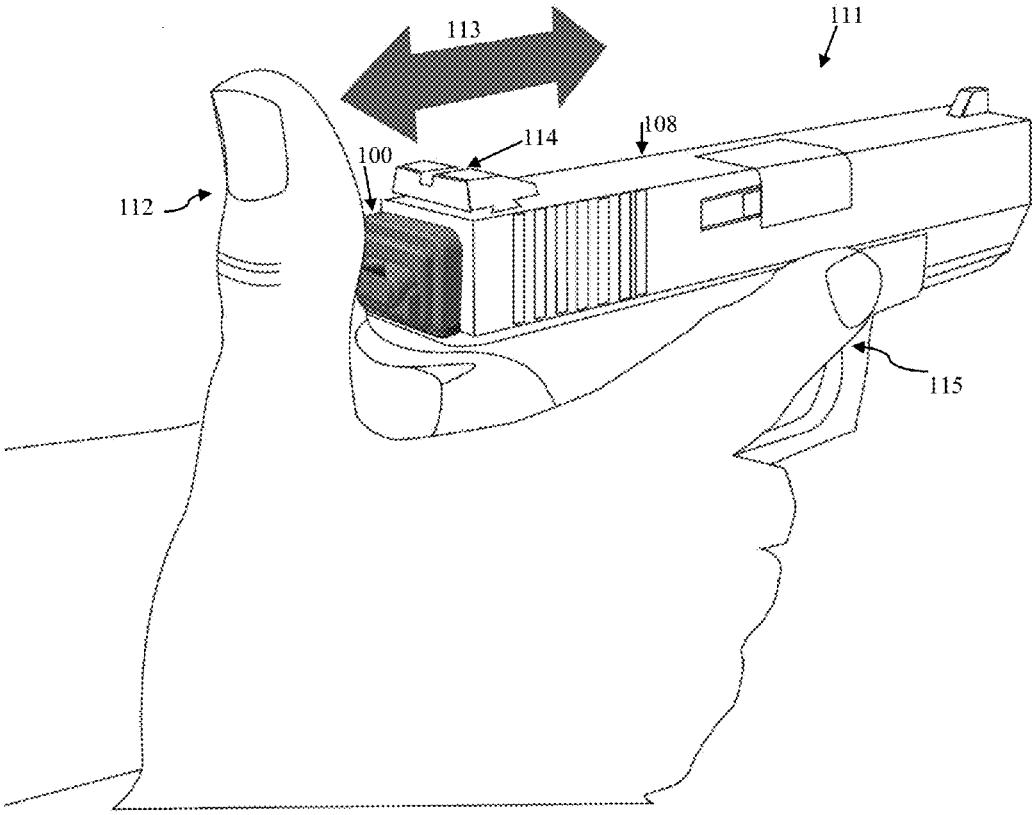
FIG. 1 illustrates a perspective view of a hand gun handled by a user, the hand gun having installed the safety apparatus, according to an embodiment.

What follows is a detailed description of the preferred embodiments of the invention in which the invention may be practiced. Reference will be made to the attached drawings, and the information included in the drawings is part of this detailed description. The specific preferred embodiments of the invention, which will be described herein, are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

Reference will now be made to FIGS. 1 through 9*b* to describe an embodiment of the safety apparatus and a method of using it for safe handling and holstering of a weapon having the safety apparatus installed.

Figure 2:
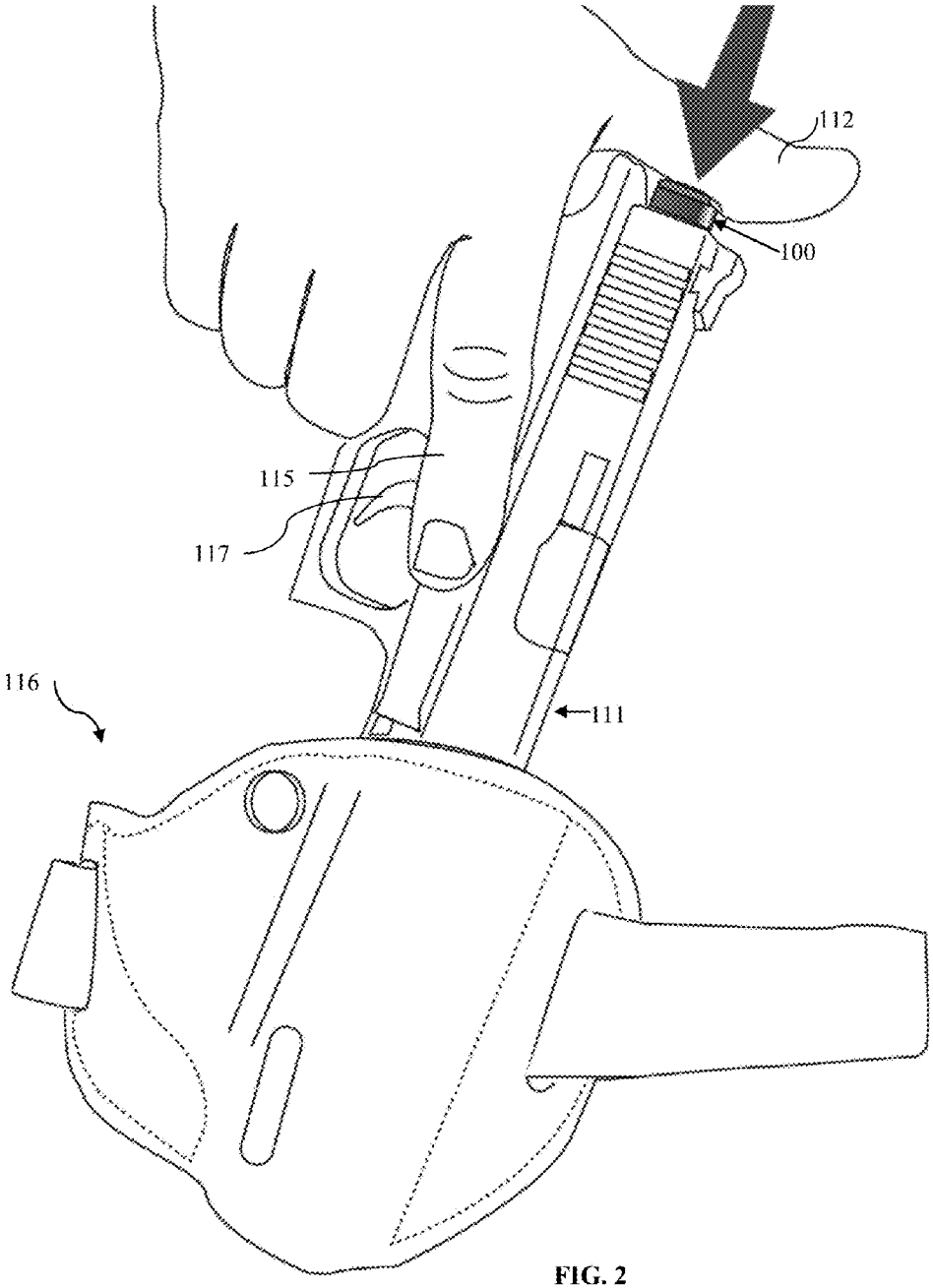
FIG. 2 illustrates a perspective view of a hand gun holstered by a user, the hand gun having the safety apparatus actuated by the user, according to an embodiment.

As shown in FIGS. 1-2, the safety apparatus 100 for striker-fired weapons 111, aids in the reduction of accidental or negligent discharge by giving the operator the ability to disengage trigger 117 with a unique grip of the weapon 111, through pressure of the operator's thumb 112 on the safety apparatus 100. This is a new manual of arms. As shown, the weapon 111 is gripped normally (notice position of trigger finger 115 and trigger 117), with a noteworthy change that the thumb 112 rides at the rear of the slide 108 applying pressure to the safety apparatus 100, whenever handling the weapon, particularly when holstering of the weapon (FIG. 2). This is the safe position. Whenever the user wants the weapon 111 ready to fire, she moves her thumb 112 to the traditional grip position and the weapon is ready to fire. It is also noteworthy that, for example, law enforcement could hold the safety apparatus 100 when holding violent suspects at gunpoint. With the user's thumb 112 upward on the safety apparatus 100 (see FIG. 1), the view of the rear sight 114 is slightly obstructed, thus letting the officer know she is in a safe mode and needs to move her thumb 112 to fire as she aims the weapon 111.

Thus, by pressing the safety apparatus 100 with user's thumb 112, components of the safety apparatus move forward, as it will be described in more details below, and they will spring back when the thumb is removed (see 113). Thus, the user has the option to momentarily change the weapon to cold/safe mode for safe handling and/or holstering and revert quickly to hot/ready-to-fire mode, by simply removing her thumb 112 from the safety device 100.

In the safe position, should the trigger 117 ever be inadvertently moved, by for example a portion of a worn out holster 116, in a typical Glock™ handgun for example, because of the action of the safety apparatus 100 on a firing mechanism's component (e.g., connector), the trigger bar would not release the striker, and thus, the weapon would not fire, as long as the button 102 of the safety apparatus 100 is pressed. In other designs of the firing mechanism, because of the action of the safety apparatus on a firing mechanism component, for example, the trigger bar may not move (e.g., pull back) the striker and thus not fire the weapon, as long as the button 102 of the safety apparatus 100 is pressed.

Again, as soon as the button 102 is released, the weapon is hot. Thus, the safety mechanism 100 acts as a momentary safety switch. The moving from the safe position grip to a normal firing grip will release the safety. Should the weapon 111 be "grabbed" in a panic situation the weapon will be hot, ready to fire.

The button 102 may have various shapes such as to provide a smooth, comfortable contact surface 102*b* (FIG. 3) with the user's thumb, or to provide a sharp end 102*bb* (FIGS. 8*a*, 10 and 11*b*), or an irregular, ribbed surface 102*bbb*, as to inflict a certain amount of discomfort to the user as the pressure is increased. The tactile feedback provided by the latter two designs should help the user have better awareness of the safety apparatus in a high stress moment.

Again, a Glock™-style weapon design is used in the drawings and assumed in this description for the purpose of simplifying the disclosure. However, it should be understood that the safety apparatus and method disclosed herein will work similarly on other striker-fire weapon designs, with only small modifications. Therefore, such modifications are within the spirit and scope of the invention disclosed herein.

Figure 3:
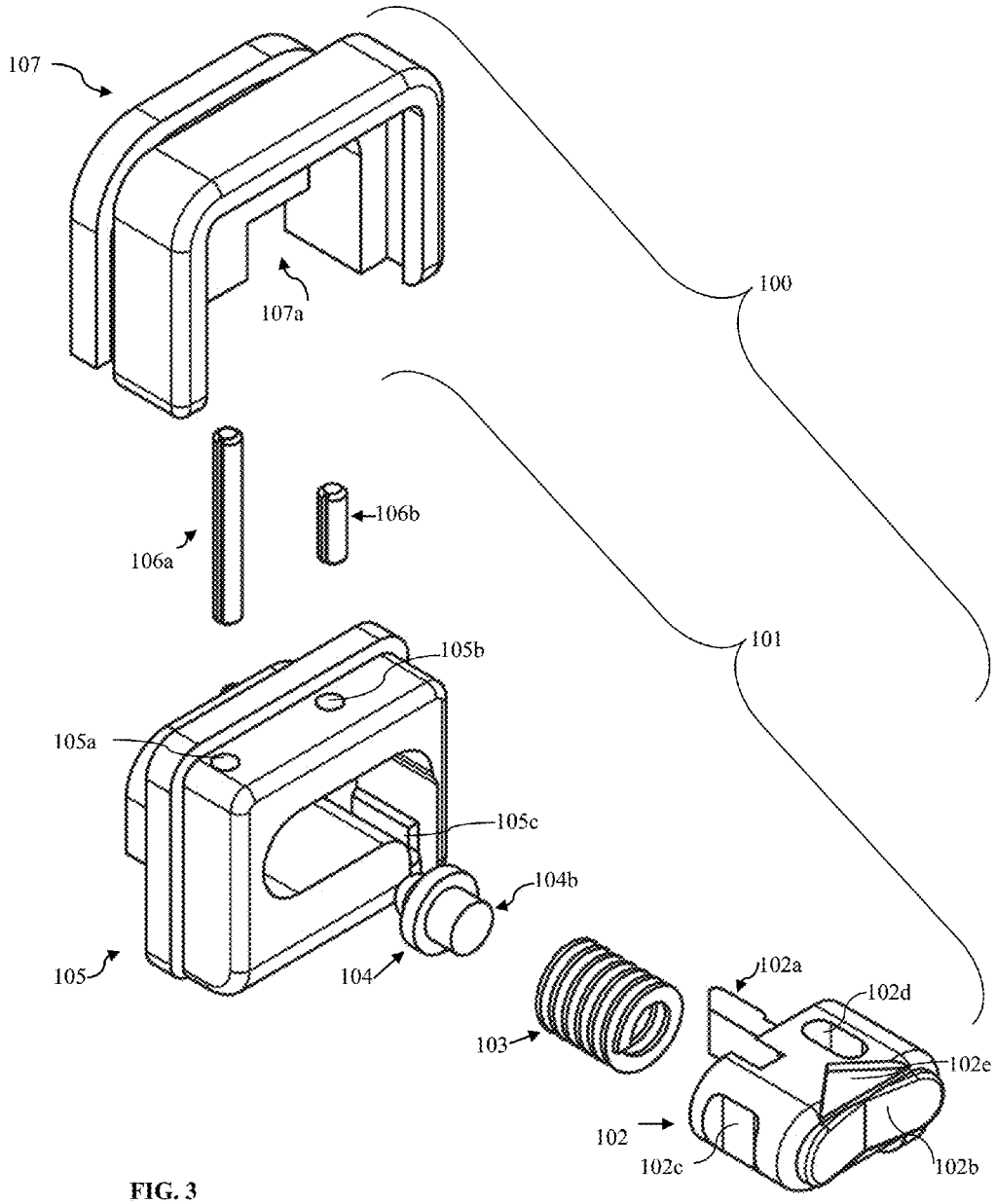
FIG. 3 illustrates an exploded view of the safety apparatus, according to an embodiment.

As shown in FIG. 3 (exploded view), in an embodiment, the safety apparatus 100 may include a button assembly 101 and a replacement end plate 107. The button assembly 101 may include a button 102, a compression spring 103, a rod member 104, a button housing 105, and two guiding and retaining pins 106*a-b*. When the button assembly 101 is assembled, it looks like 101 in FIG. 4. The button assembly 101 may be assembled as follows: one end of the spring 103 is placed into a cavity (not shown) of the button 102 and the other end over the spring ride rod portion 104*b* of the rod member 104; the other portion 104*a* (see FIGS. 6-7) of the rod member 104, having a rounded shape, acts as a detent snap bearing under the influence of the spring 103, and in conjunction with a corresponding plate cavity 107*c*, in which it fits, helps secure the button housing 105 to the replacement end plate 107 after the former is pushed to slide from the bottom into the latter; the two pins 106*a* and 106*b* fit through the openings 105*a* and 105*b*, respectively, and reach into cutouts 102*c* and 102*d*, respectively, to retain the button 102 in its housing 105 and to guide the button during the forward and backward movement of the button 102 under the influence of the user thumb, which will compress the spring, and of the compressed spring, respectively. It should be noted that the button 102 has a ram bar 102*a* extending from it forwardly, which when the safety apparatus 100 is assembled, passes through channel 105*c* and aperture 107*a*, and preferably reaches beyond the inner surface 107*d* of replacement end plate 107, as shown in FIGS. 9*a-b*. The ram bar 102*a* has a tapered end 102*aa* (FIGS. 6, 7, 8*b*, 9*a*, 9*b*) to facilitate action on the firing mechanism as it will be described in details later herein. As shown, the ram bar 102*a* may be a rectangular section bar that is incorporated in the button 102. It should also be noted that a suggestive arrowhead-like graphic 102*e* may be provided on the upper side of the button 102 to indicate the direction in which the user need to exercise pressure with her thumb in order to actuate the safety apparatus.

Figure 4:
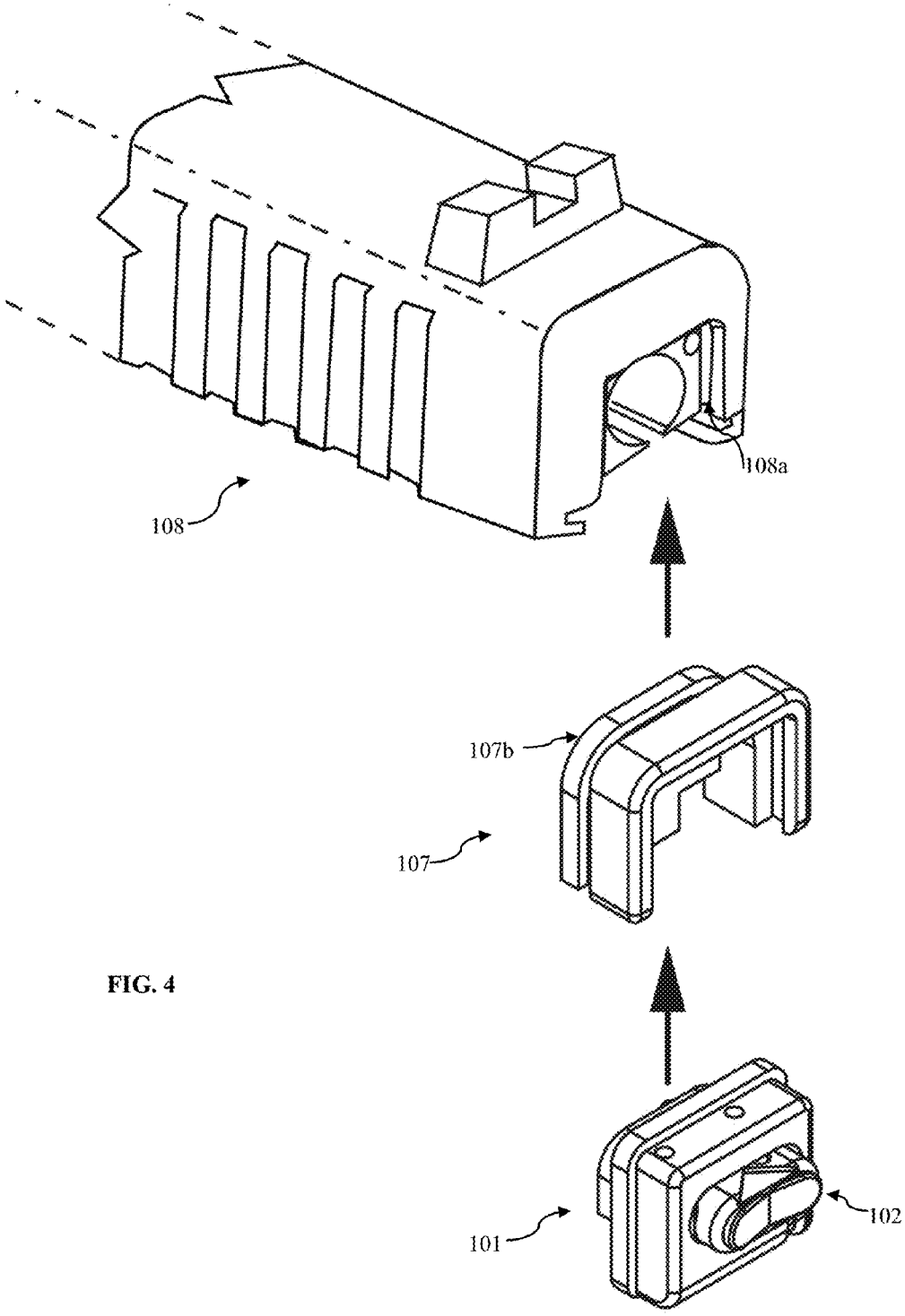
FIG. 4 illustrates a partially exploded view of the safety apparatus from FIG. 3, in an uninstalled relation with the slide of the gun from FIGS. 1-2.
Figure 5A:
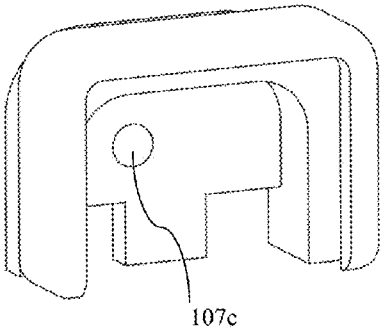
FIGS. 5*a-b* illustrate a back perspective view and a back view, respectively, of the replacement end plate of the safety apparatus from FIG. 3, according to an embodiment.
Figure 5B:
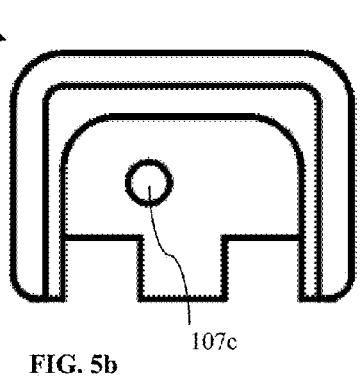
Figure 6:
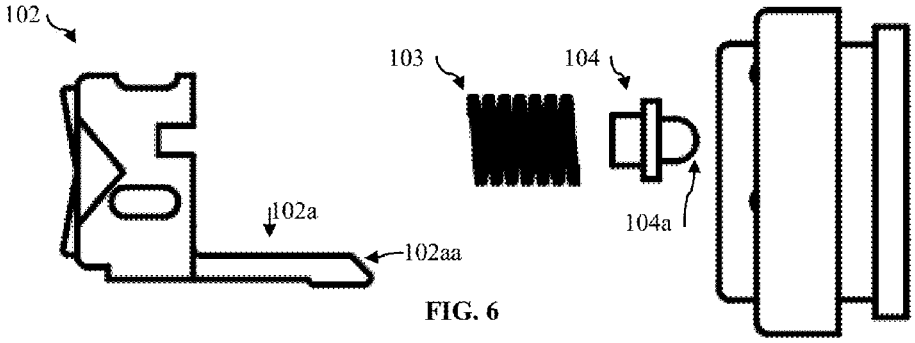
FIG. 6 illustrates a top, partially exploded view of the button assembly of the safety apparatus from FIG. 3.
Figure 7:
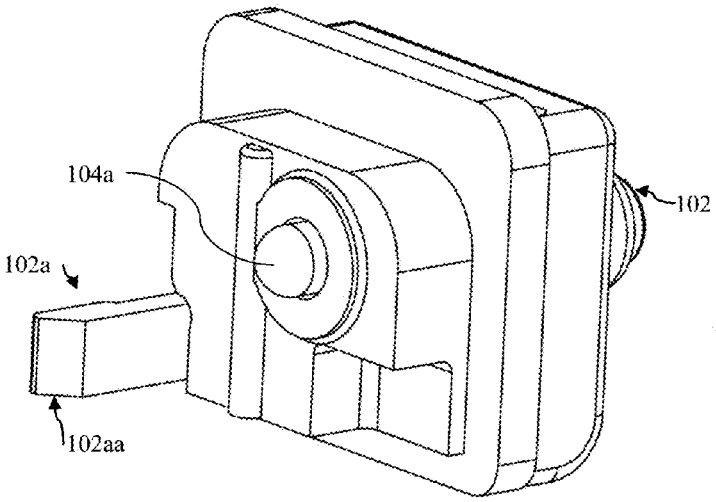
FIG. 7 illustrates a back perspective view of the safety apparatus (without replacement end plate) from FIG. 3.
Figure 12A:
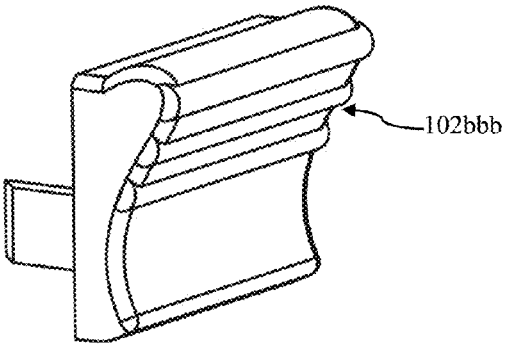
FIGS. 12*a-d* illustrate the front perspective, top, left and front view, respectively, of an alternative design of the button of the safety apparatus, according to another embodiment.
Figure 12B:
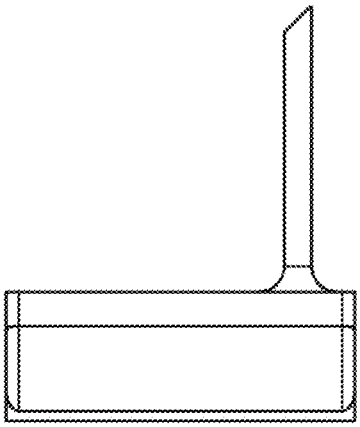
Figure 12C:
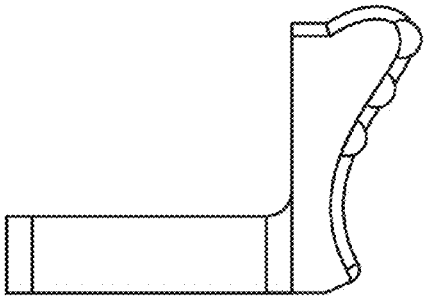
Figure 12D:
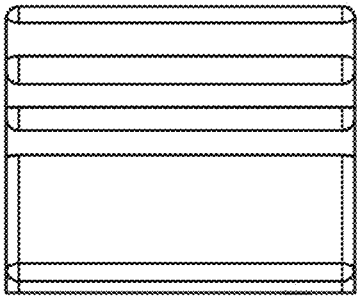
Figure 12E:
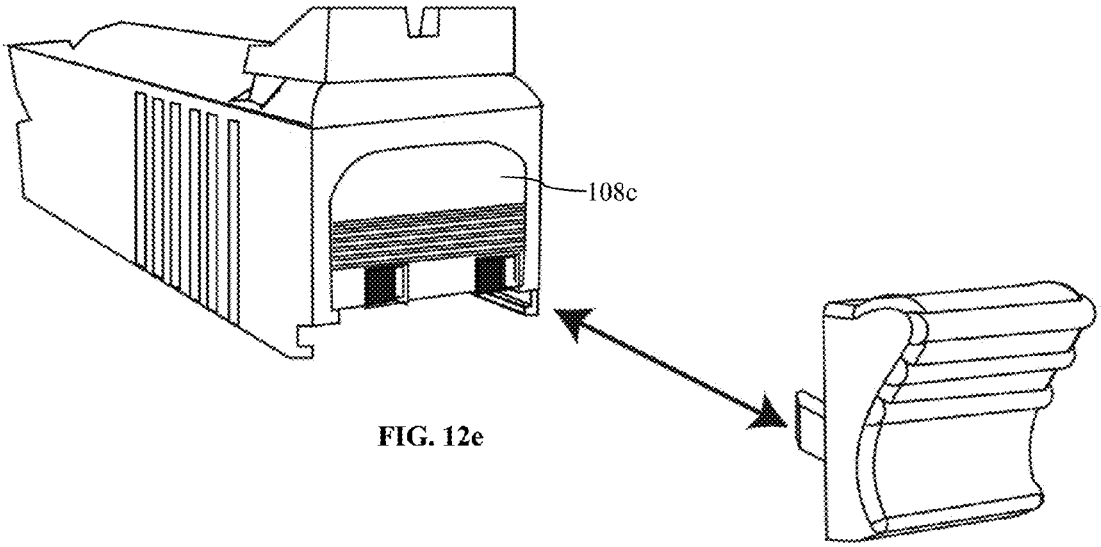
FIG. 12*e* illustrates the button from FIGS. 12*a-d* in an uninstalled relation with the slide of the gun from FIGS. 1-2.

As suggested in FIG. 4, after removal of the manufacturer end plate 108*c* (FIG. 12*e*) from the slide 108, the replacement end plate's 107 shoulder 107*b* will typically be pushed to slide upwards into the slide's groove 108*a*, and then, the preassembled button assembly 101 will be snapped into the replacement end plate 107 with the aid of the detent snap bearing 104*a* (FIG. 7) as described earlier. When installed into the slide 108, the weapon-safety apparatus assembly looks as depicted in FIGS. 1-2, and is operable as described earlier when referring to the same figures.

Naturally, the safety apparatus 100 may be disassembled in reverse order, for cleaning purposes, for example.

Figure 8A:
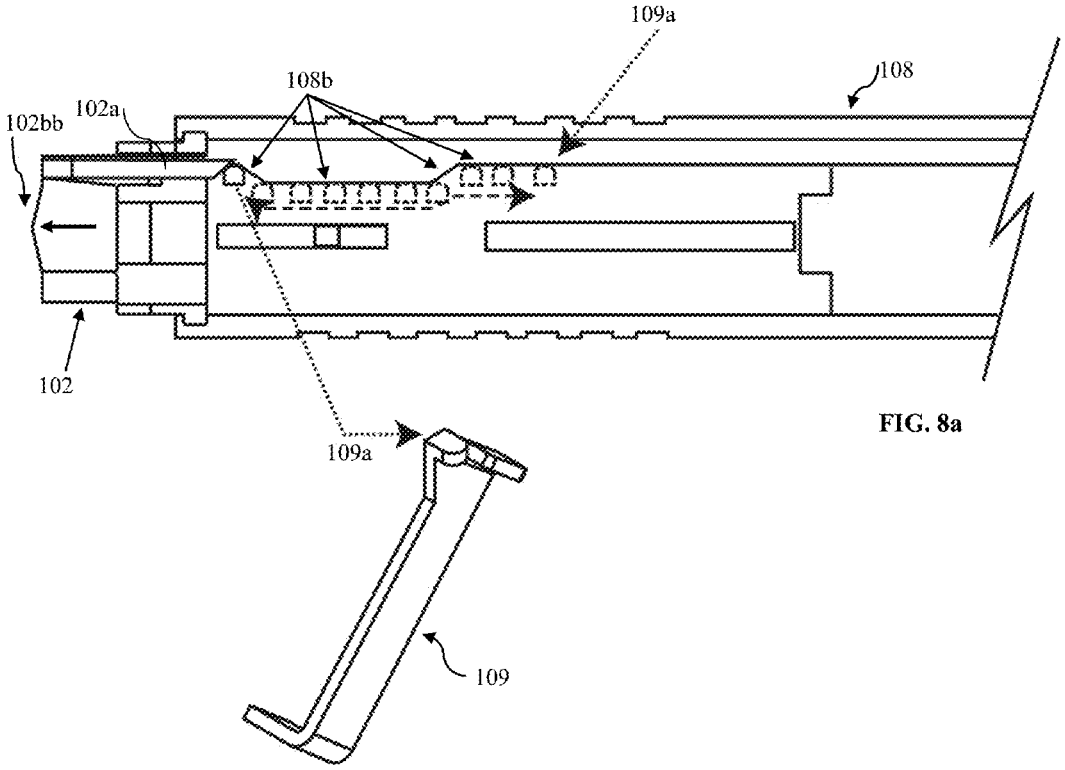
FIG. 8*a* illustrates the bottom of the slide of the gun from FIGS. 1-2 and the safety apparatus in a disengaged position, according to an embodiment.
Figure 8B:
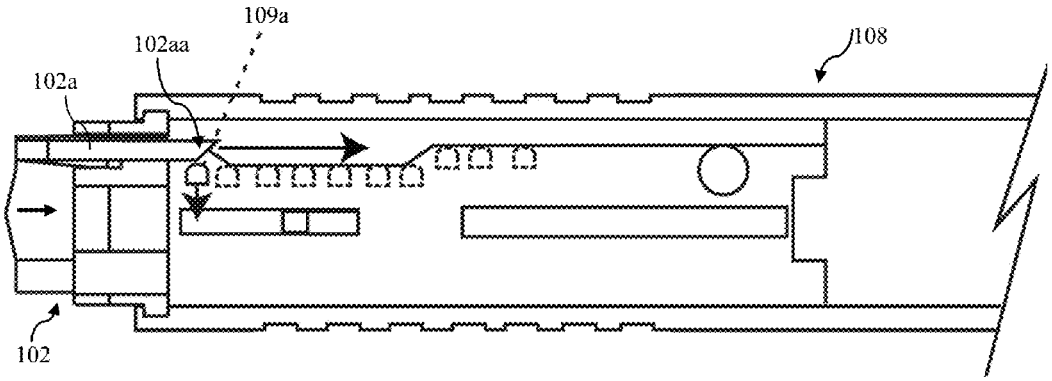
FIG. 8*b* illustrates the bottom of the slide of the gun from FIGS. 1-2 and the safety apparatus in an engaged position, according to an embodiment.
Figure 9A:
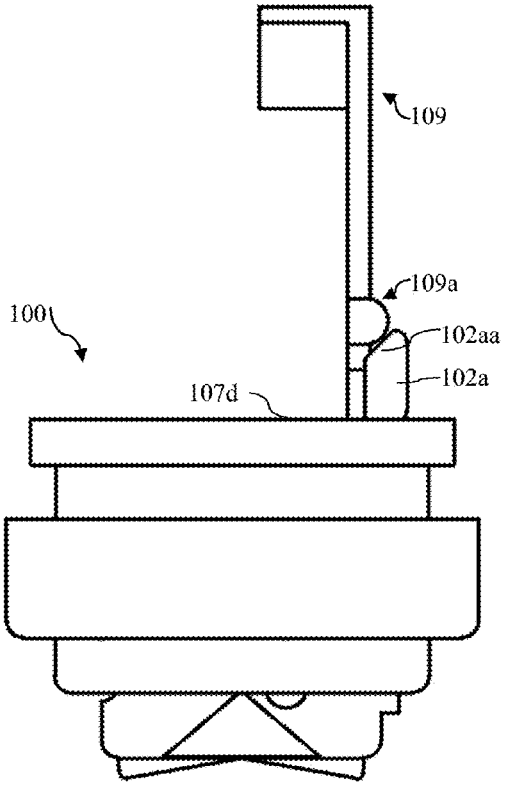
FIGS. 9*a-b* illustrate the top and front perspective view, respectively, of the safety apparatus in relation to a component of the firing mechanism of a gun, according to an embodiment.
Figure 9B:
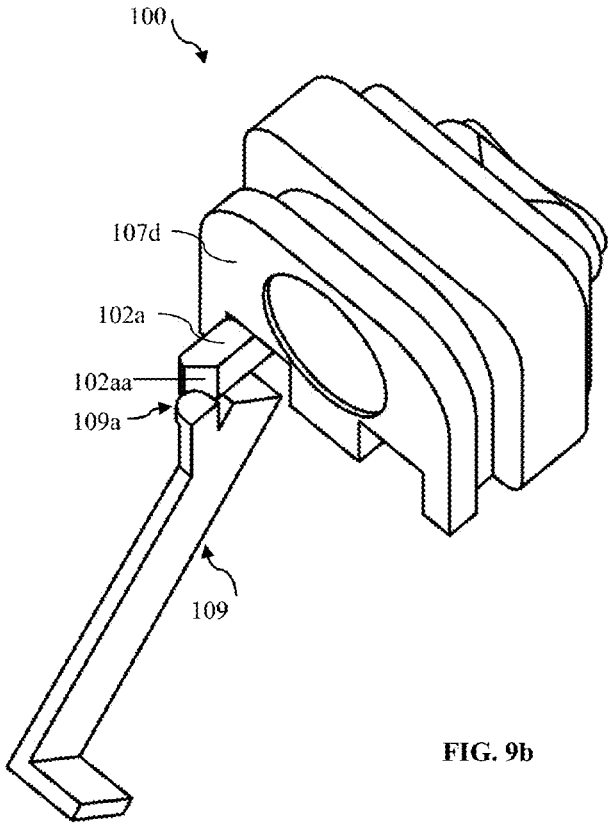

The internal operation of the safety apparatus 100 will be now described by making references to FIGS. 8*a-b* and 9*a-b*. FIG. 8*a* illustrates the bottom of the slide of the gun from FIGS. 1-2 and the safety apparatus in a disengaged position, according to an embodiment. FIG. 8*b* illustrates the bottom of the slide of the gun from FIGS. 1-2 and the safety apparatus in an engaged position, according to an embodiment. FIGS. 9*a-b* illustrate the top and front perspective view, respectively, of the safety apparatus in relation to a component of the firing mechanism of a gun, according to an embodiment.

In the absence of external pressure (e.g., from user's thumb), the spring 103 (FIG. 3) keeps the safety apparatus 100 static in the weapon when in the pre-loaded position, as seen in FIG. 8*a*. This is the firing mode. A backward oriented pressure is exercised by the spring 103 on button 102 to prevent button 102, and thus, ram bar 102*a* from moving forward. It should be understood that even if the drawing in FIG. 8*a* may suggest that there may be some contact between the ram bar 102*a* and a component of the firing mechanism (i.e., connector 109 in this example), there is no interference in this mode between the ram bar 102*a* and the structure and function of the weapon's firing mechanism. The firing mechanism functions in this mode undisturbed, as designed by the manufacturer, ready-to-fire. Thus, clear separation between the ram bar 102*a* and the firing mechanism may be clearly employed in this mode, as an alternative design.

Pressing the safety apparatus' button 102 forward (FIG. 8*b*), moves the safety apparatus' ram bar 102*a* and its tapered end 102*aa* into the slide 108. Consequently, the ram bar 102*a*, by acting on an upper element 109*a* of the connector 109, moves the connector towards the center line of the slide 108 (see FIG. 8*b*). In a typical firing mechanism of a Glock™, this causes the functional continuity of the firing mechanism, as designed by the manufacturer, to be momentarily interrupted, thus disengaging the trigger by preventing the trigger bar from releasing the striker. Again, as mentioned earlier, in alternative designs of the firing mechanism, this interruption may prevent, for example, movement (e.g., pull back) of the striker. In either case, although the trigger will be typically allowed to move full range, no matter how much pressure on the trigger is exercised, for example, by the user's trigger finger, the weapon will not fire.

It should be noted that, the design of the safety apparatus 100, as described herein, does not affect the weight of the trigger pull when the thumb is in the normal grip, firing position. Similarly, when, in the preferred embodiment, the safety apparatus acts on the connector as described herein, the trigger pull is not substantially affected as well.

The Glock™ connector rides a contoured rail 108*b* on the inside of the slide 108, as shown in FIG. 8*a*. Under firing recoil this contour slides past the connector 109. Thus, the connector 109 is moved laterally, towards the centerline of the weapon, momentarily. This action disengages, resets and then engages the trigger. Whenever the connector is moved towards the centerline, the trigger is disengaged. The safety apparatus 100 disclosed herein takes advantage of this action.

The safe button 102 with the ram bar 102*a* act on the factory connector 109 when the weapon is in ready-to-fire mode. As the thumb presses the safe button (see FIG. 2) the ram bar moves linearly into the slide (see FIG. 8*b*) and moves the connector (109*a* in FIG. 8*b*) laterally, towards the center line (similar to what the slide contour does under recoil). This action prevents release of the striker at the end of the backward travel of the trigger bar, and makes the weapon safe.

Figure 10:
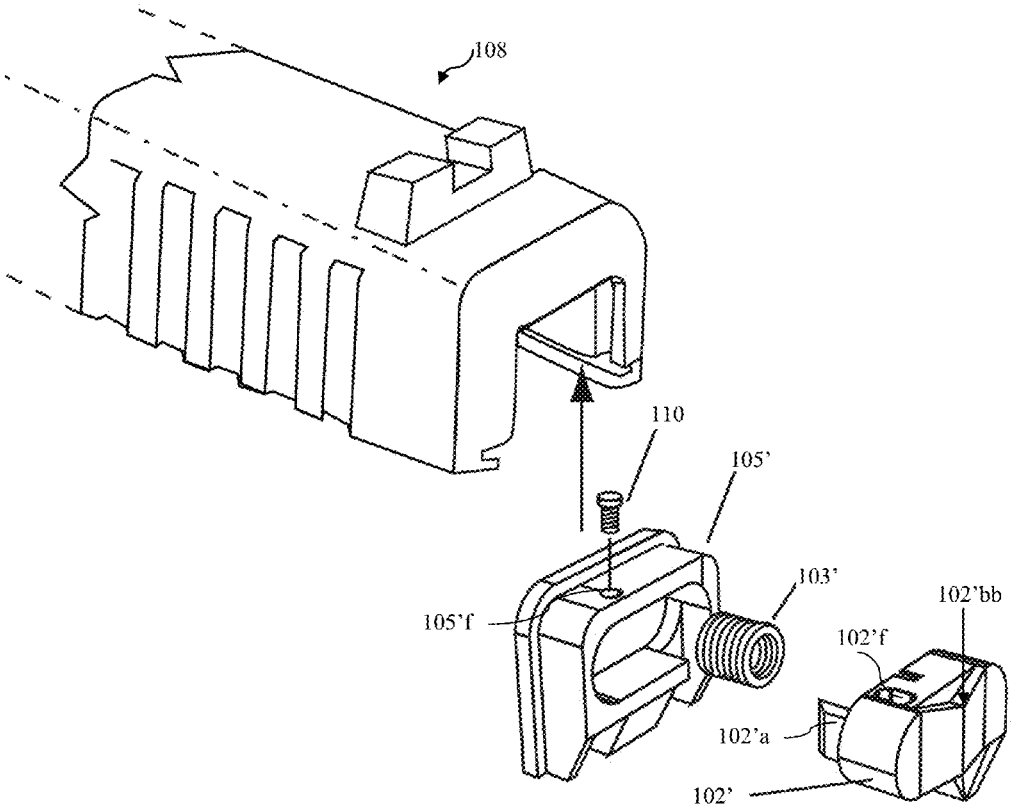
FIG. 10 illustrates an exploded view of an alternative design of the safety apparatus, in an uninstalled relation with the slide of the gun from FIGS. 1-2, according to an embodiment.
Figure 11A:
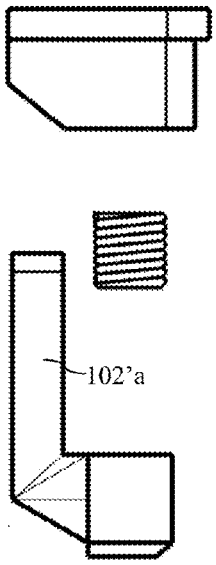
FIGS. 11*a-c* illustrate the left, top and right exploded view, respectively, of the safety apparatus from FIG. 10.
Figure 11B:
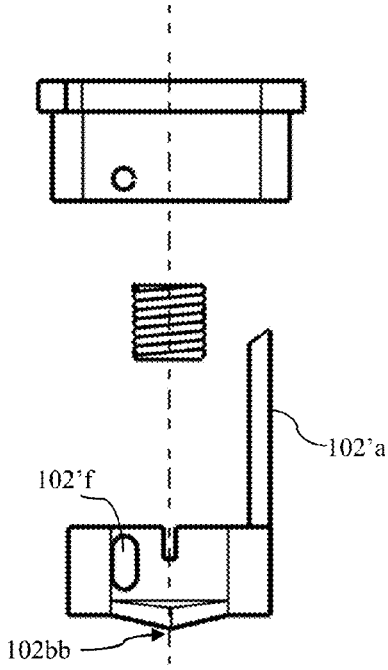
Figure 11C:
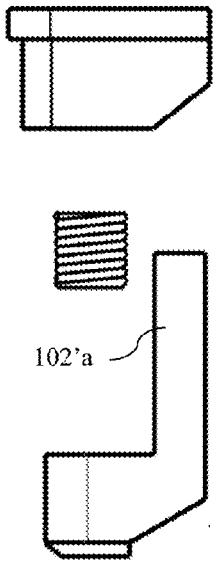

FIG. 10 illustrates an exploded view of an alternative design of the safety apparatus, in an uninstalled relation with the slide of the gun from FIGS. 1-2, according to an embodiment. In this embodiment, the replacement end plate 105' also houses the button 102' and return spring 103'. The button 102' includes the ram bar 102'*a* (see also FIGS. 11*a-c*) and is retained with the threaded retaining pin 110 received by the threaded end plate opening 105'*f*. The compression return spring 103' is installed between the button 102' and end plate 105' as a return force upon release of the safety apparatus. Button 102', end plate 105' and retaining pin 110 can all be envisioned as manufactured in any combination of metal or polymers. The retaining pin 110 helps retain and guide the button 102' in the end plate 105' by entering button opening 102'*f* (see also FIG. 11*b*).

It should be noted that the button of the safety mechanism disclosed herein may also be provided with an option of being locked or held in the pressed/actuated position by, for example, a locking plate pivotally connected to the button housing or end plate, for optional positioning by the user such as to prevent return of the button when the thumb is removed from the button.

Thus, as earlier described, the safety apparatus disclosed herein is installed at the rear of slide of the weapon and gives the operator the option of pressing the apparatus to disengage the trigger. In this exemplary embodiment, the safety apparatus acts on the weapon's factory connector and prevents the trigger bar from releasing the striker, thus making the weapon safe momentarily. The safety apparatus is spring loaded to return to a firing position as soon as the user releases the apparatus' button, thus the weapon is quickly ready to fire. Thus, an advantage of the safety apparatus disclosed herein is that it aids in the reduction of accidental discharge or negligent discharge by a user while handling or holstering the weapon. It is important to note that the safety apparatus adds to safety, while at the same time the firearm is ready to fire as soon as the user returns to a normal grip. The weapon can never be in a condition that it won't fire if it is loaded and gripped normally.

It is noteworthy that this safety apparatus only acts preferably on the connector and not on the striker in any way. This is considered a major advancement over prior art. Some prior art acts on the striker. As mentioned before, it is believed that any safety apparatus that acts on the striker lends itself to serious safety issues of firing slightly out of battery under certain conditions. Out of battery discharges are well known to destroy these weapons and harm users.

Again, other prior art shows manual safeties that are switched with distinct on or off positions, leaving the possibility that the safety could be left on safe by accident and user is unaware that the weapon is not ready to use. By contrast, the safety apparatus disclosed herein is momentary. It maintains the aspect that the weapon is always ready to fire when gripped normally. The new manual of arms used with the disclosed safety apparatus makes striker weapons safer to handle and holster.

It may be advantageous to set forth definitions of certain words and phrases used in this patent document.

The phrase "disengage trigger" and variations thereof means that, because of an action of the safety apparatus on a component of the weapon's firing mechanism (e.g., connector), the trigger is typically allowed to move full range under the action of a user's finger or of other objects (e.g., user's clothing, holster parts, etc.), without causing the weapon to fire, irrespective of the amount of force applied by user's finger or such other objects to the trigger.

The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

As used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims. Use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the embodiments and examples shown should be considered as exemplars, rather than limitations on the apparatus and procedures disclosed or claimed. Although many of the examples involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

Although specific embodiments have been illustrated and described herein for the purpose of disclosing the preferred embodiments, someone of ordinary skills in the art will easily detect alternate embodiments and/or equivalent variations, which may be capable of achieving the same results, and which may be substituted for the specific embodiments illustrated and described herein without departing from the scope of the invention. Therefore, the scope of this application is intended to cover alternate embodiments and/or equivalent variations of the specific embodiments illustrated and/or described herein. Hence, the scope of the invention is defined by the accompanying claims and their equivalents. Furthermore, each and every claim is incorporated as further disclosure into the specification and the claims are embodiment(s) of the invention.

What is claimed is:

1. A safety apparatus for a striker-fired weapon, the striker-fired weapon having a slide and a firing mechanism, the firing mechanism comprising a trigger, a trigger bar that is operatively associated with the trigger, a spring loaded striker and a connector configured to tilt downward the trigger bar at an end of a backward travel in order to release the striker, the safety apparatus being mountable at a back end of the slide and comprising a spring loaded button associated with a ram bar, wherein, when the spring loaded button is actuated by a user, the ram bar temporarily displaces the connector, such that to prevent the trigger bar from releasing the striker, although the weapon's trigger can still move full range, the striker-fired weapon being thus temporarily in safe mode, wherein, as soon as the user releases the spring loaded button, the spring loaded button returns to a position held before actuation by the user, causing the ram bar to stop the temporary displacement of the connector, the striker-fired weapon being thus returned to a normal, ready-to-fire mode, wherein the spring loaded button is configured to be actuated by a push forward action by the user's thumb.

2. The safety apparatus of claim 1, wherein the ram bar temporarily displaces the connector by pushing it toward a centerline of the slide.

3. The safety apparatus of claim 2, further comprising a replacement end plate configured to replace a weapon manufacturer's end plate from the back end of the slide, to house the spring loaded button and an associated compression spring, and to receive a pin for securing and guiding the spring loaded button.

4. The safety apparatus of claim 2, further comprising a replacement end plate configured to replace a weapon manufacturer's end plate from the back end of the slide, to receive a button housing that houses the spring loaded button, an associated compression spring and a rod member for receiving the compression spring at one end and for acting as a detent snap bearing at the other end for securing the button housing to the replacement end plate, the button housing being configured to receive a plurality of pins for securing and guiding the spring loaded button.

5. The safety apparatus of claim 2, wherein the spring loaded button has an uneven back surface, such that to inflict a tactile discomfort to user's thumb during the push forward action, thus increasing the user's awareness that the striker-fired weapon is in safe mode.

6. The safety apparatus of claim 1, wherein the ram bar is integral to the spring loaded button, and wherein the ram bar has a front end tapered for facilitating the temporary displacement of the connector.

7. A striker-fired weapon comprising a slide and a firing mechanism and having a safety apparatus installed at a back end of the slide, the firing mechanism comprising a trigger, a trigger bar that is operatively associated with the trigger, a spring loaded striker and a connector configured to tilt downward the trigger bar at the end of a backward travel in order to release the striker, the safety apparatus comprising a spring loaded button associated with a ram bar, wherein, when the spring loaded button is actuated by a user, a temporary disruption of the functional continuity of the firing mechanism is achieved by the ram bar temporarily displacing the connector, such that to prevent the trigger bar from releasing the striker, and thus, although the trigger can still move full range, discharge of the striker-fired weapon is prevented and the striker-fired weapon is thus temporarily in safe mode; and wherein, as soon as the user releases the spring loaded button, the spring loaded button returns to a position held before actuation by the user, causing the ram bar to stop the temporary disruption of the functional continuity of the weapon's firing mechanism, the striker-fired weapon being thus returned to a normal, ready-to-fire mode.

8. The striker-fired weapon of claim 7, wherein the spring loaded button is configured to be actuated by a push forward action by the user's thumb.

9. The striker-fired weapon of claim 8, wherein the ram bar is integral to the spring loaded button, and wherein the ram bar has a front end tapered for facilitating the temporary displacement of the connector.

10. The striker-fired weapon of claim 7, wherein the ram bar temporarily displaces the connector by pushing it toward a centerline of the slide.

11. The striker-fired weapon of claim 7, wherein the safety apparatus further comprises a replacement end plate configured to replace a weapon manufacturer's end plate from the back end of the slide, to house the spring loaded button and an associated compression spring, and to receive a pin for securing and guiding the spring loaded button.

12. The striker-fired weapon of claim 7, wherein the safety apparatus further comprises a replacement end plate configured to replace a weapon manufacturer's end plate from the back end of the slide, to receive a button housing that houses the spring loaded button, an associated compression spring and a rod member for receiving the compression spring at one end and for acting as a detent snap bearing at another end for securing the button housing to the replacement end plate, the button housing being configured to receive a plurality of pins for securing and guiding the spring loaded button.

13. The striker-fired weapon of claim 7, wherein the spring loaded button has an uneven back surface, such that to inflict a tactile discomfort to user's thumb during the push forward action, thus increasing the user's awareness that the striker-fired weapon is in safe mode.

14. A safety apparatus for a striker-fired weapon, the striker-fired weapon having a slide and a firing mechanism, the firing mechanism comprising a trigger, a trigger bar that is operatively associated with the trigger, a spring loaded striker and a connector configured to tilt downward the trigger bar at an end of a backward travel in order to release the striker, the safety apparatus being mountable at a back end of the slide and comprising a spring loaded button associated with a ram bar, wherein, when the spring loaded button is actuated by a user, the ram bar temporarily displaces the connector, such that to prevent the trigger bar from releasing the striker, the striker-fired weapon being thus temporarily in safe mode, wherein, as soon as the user releases the spring loaded button, the ram bar stops the temporary displacement of the connector, the striker-fired weapon being thus returned to a normal, ready-to-fire mode.

* * * * *